US006976405B2

(12) United States Patent
Schaeffer

(10) Patent No.: US 6,976,405 B2
(45) Date of Patent: Dec. 20, 2005

(54) DETACHMENT TOOL

(75) Inventor: Gary Schaeffer, Glendale, CA (US)

(73) Assignee: Medical Associates, Inc., Glendale, CA (US)

( * ) Notice: Subject to any disclaimer, the term of this patent is extended or adjusted under 35 U.S.C. 154(b) by 0 days.

(21) Appl. No.: 10/800,384

(22) Filed: Mar. 12, 2004

(65) Prior Publication Data

US 2005/0199099 A1 Sep. 15, 2005

(51) Int. Cl.[7] ..... B76B 7/00
(52) U.S. Cl. ..... 81/3.55; 81/489
(58) Field of Search ..... 81/3.07, 3.55, 81/3.8, 489; 254/21, 25; D8/33, 40, 88, 89

(56) References Cited

U.S. PATENT DOCUMENTS 1,043,369 A * 11/1912 Smith ..... 254/25
1,164,776 A * 12/1915 Arbanasin ..... 30/408
D206,046 S * 10/1966 Seidlein ..... D8/89
D256,442 S * 8/1980 Martin ..... D10/77
4,479,406 A * 10/1984 Shoemaker, III ..... 81/3.55
4,941,232 A * 7/1990 Decker et al. ..... 16/421
4,974,286 A * 12/1990 Stowell et al. ..... 16/421
5,097,566 A * 3/1992 Decker et al. ..... 16/421
D355,103 S * 2/1995 Bartlett ..... D8/14
5,495,651 A * 3/1996 Tsuha ..... 29/235
5,722,141 A * 3/1998 Strickland ..... 29/267
6,663,082 B1 * 12/2003 Ploeger ..... 254/21
D490,669 S * 6/2004 Komar et al. ..... D8/14
D499,627 S * 12/2004 Wilson ..... D8/89

* cited by examiner

*Primary Examiner*—David B. Thomas
(74) *Attorney, Agent, or Firm*—James E. Brunton, Esq.

(57) ABSTRACT

A detachment tool for use in detaching a detachable part from a two-part article having a fixed part and a detachable part. The detachment tool uniquely enables persons having impaired motor skills, persons having hand muscular difficulties and persons suffering from certain disabling conditions such as arthritis, to readily remove detachable parts from various types of two-part articles such as articles adapted for dispensing certain types of medicaments.

2 Claims, 5 Drawing Sheets

DETACHMENT TOOL

BACKGROUND OF THE INVENTION

1. Field of the Invention

The present invention relates generally to detachment tools for use in detaching detachable parts from two-part articles having a fixed part and a detachable part. More particularly, the invention concerns specially designed detachment tools that enable persons having impaired motor skills, persons having hand muscular difficulties and persons suffering from certain disabling conditions such as arthritis, to readily remove detachable parts from various types of two-part articles used for dispensing certain medicaments.

2. Discussion of Prior Art

Many people are required on a frequent basis to self-administer various types of medicaments. Often these people are elderly or suffer from various physically disabling conditions that make manipulation of drug containers, syringes and similar self-administration apparatus extremely difficult. Other individuals may suffer from impaired motor skills and hand muscular difficulties that make the gripping and manipulation of small articles such as drug containers, syringes and the like difficult if not impossible. Many physically impaired people live in a home care environment where they may not have access to non impaired individuals for assistance and if they cannot self administer the required medicaments in a timely manner serious consequences can result.

While applicant is unaware of any prior art devices, that assist in the self-administration of medicaments, several types of devices for assisting physically disabled persons in dressing themselves have been suggested. By way of example, a number of prior art devices for fastening a garment having a button and buttonhole on the body of the wearer have been suggested in the past. Typically, these devices include a nose member for fitting into the buttonhole of the garment and a collar member formed rearward of the nose member to fit over the button and connect with the button. A neck portion connects the collar member and the nose member. The neck member has spaced guide members which are adapted to fit between the button and the garment. A gripping shaft or stem of the apparatus extends from the collar member. The gripping shaft is gripped by an individual to manipulate the apparatus in fastening the garment.

Similarly, a number of prior art devices have been suggested for use in zipping and unzipping zippers. Such devices typically include a gripping portion to which a hook is interconnected. The hook is used to zip and unzip zippers by inserting the hook through the pull-tab provided on zippers.

SUMMARY OF THE INVENTION

It is an object of the present invention to provide a universal detachment tool for use in detaching a detachable part from a two-part article having a fixed part and a detachable part. More particularly, it is an object of the invention to provide a specially designed detachment tool that enables persons having impaired motor skills, persons having hand muscular difficulties and persons suffering from certain disabling conditions such as arthritis, to readily remove detachable parts from various types of two-part articles used in the dispensing of certain medicaments.

Another object of the invention is to provide a universal detachment tool of the aforementioned character that can be used by individuals with arthritis, Parkinson's, cerebral palsy and other afflictions affecting manual dexterity.

Another object of the invention to provide a universal detachment tool that includes a pry element that can be used to readily remove closure caps from various articles, including medicament containers or vials.

Another object of the invention is to provide a universal attachment tool of the class described that can be used to expeditiously remove stopper plugs from medicament delivery syringes.

Another object of the invention is to provide a universal attachment tool of the character described in the preceding paragraphs that can be used to expeditiously remove needle protector covers from medicament delivery syringes.

Another object of the invention is to provide a universal detachment tool for use with articles for medicament delivery that can be used by an individual with a minimum amount of exertion and effort.

Another object of the invention is to provide a universal detachment tool as described in the preceding paragraphs that allows individuals with limited hand and or finger dexterity to successfully manipulate various types of self-administration devices.

Another object of the invention is to provide a universal detachment tool of the class described that can be used by right handed or left handed individuals.

It is a further object of the invention to provide a universal detachment tool that is of a simple design and one that can be inexpensively manufactured in large volume.

DESCRIPTION OF THE INVENTION

Figure 1:
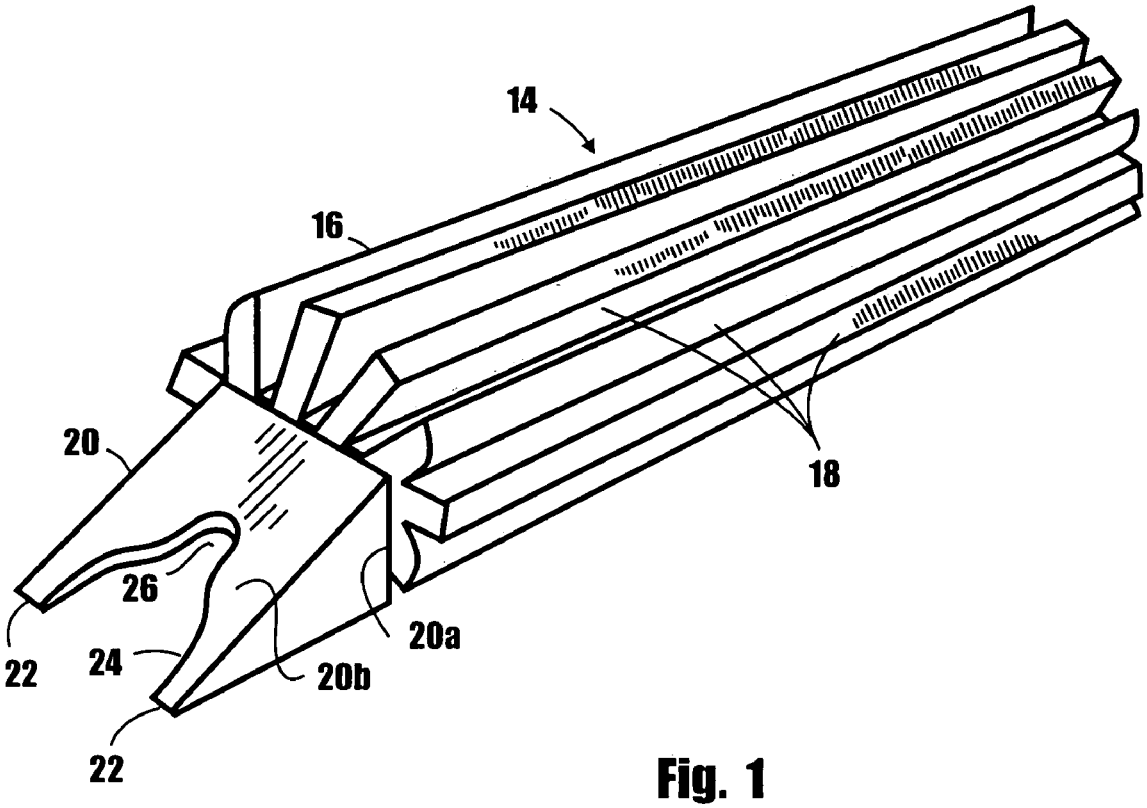
FIG. 1 is a generally perspective view of one form of the attachment tool of the invention.
Figure 2:
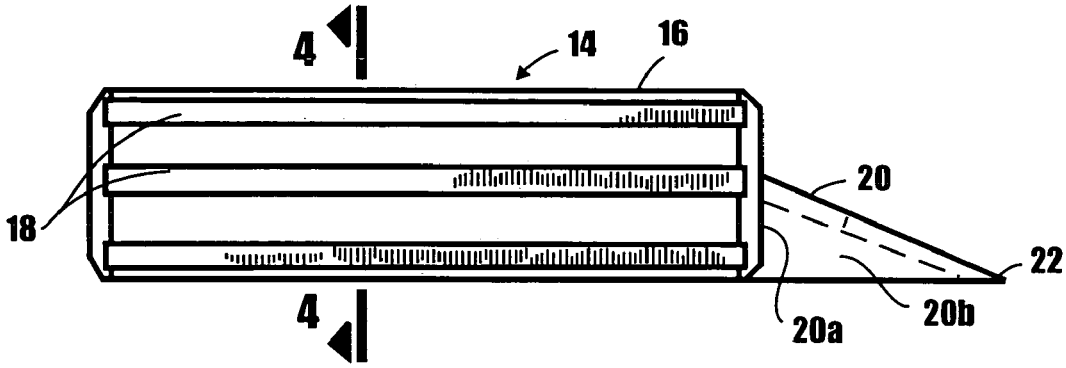
FIG. 2 is a side-elevational view of the tool.
Figure 3:
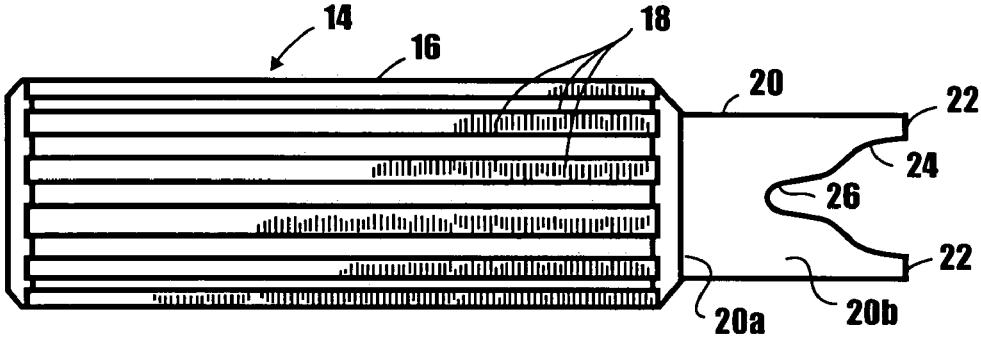
FIG. 3 is a top view of the tool.
Figure 4:
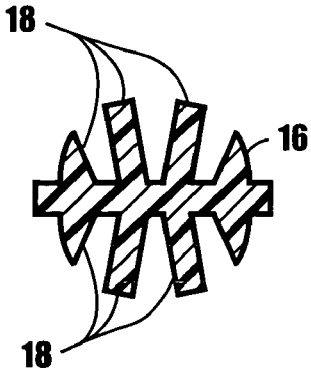
FIG. 4 is a cross-sectional view taken along lines 4—4 of FIG. 2.
Figure 5:
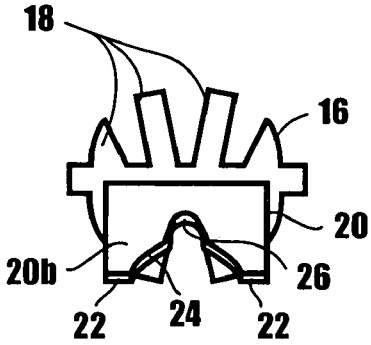
FIG. 5 is a right end view of the tool shown in FIG. 3.

Referring to the drawings and particularly to FIGS. 1 through 5, one form of the detachment tool of the invention is there shown and generally designated by the numeral 14. Broadly speaking, the detachment tool of the invention is uniquely designed for use in detaching a detachable part from a two-part article having a fixed part and a detachable part. In the present form of the invention the detachment tool comprises an elongated hand and finger grip portion 16 having a plurality of circumferentially spaced, yieldably deformable rib portions 18 and a generally wedge shaped extension portion 20 that is affixed to and extends from the grip portion. Extension portion 20 includes an end portion 20*a* that is connected to grip portion 16 and a body portion 20*b* that terminates in a pair of spaced apart pry elements 22.

Body portion 20*b* is provided with a first, generally U-shaped opening 24 of a first size and an adjacent, generally U-shaped opening 26 of a second smaller size. The wedge shaped extension portion 20 of the tool is preferably constructed from a durable metal or plastic, while grip portion 16 is preferably constructed of elastomeric material that will permit the rib portions of the grip to be compressibly deformable when gripped by the user. With such a construction, the user of the tool can comfortably and securely grip portion 16 even though suffering from limited manual dexterity, arthritic pain, finger stiffness and the like.

Figure 6:
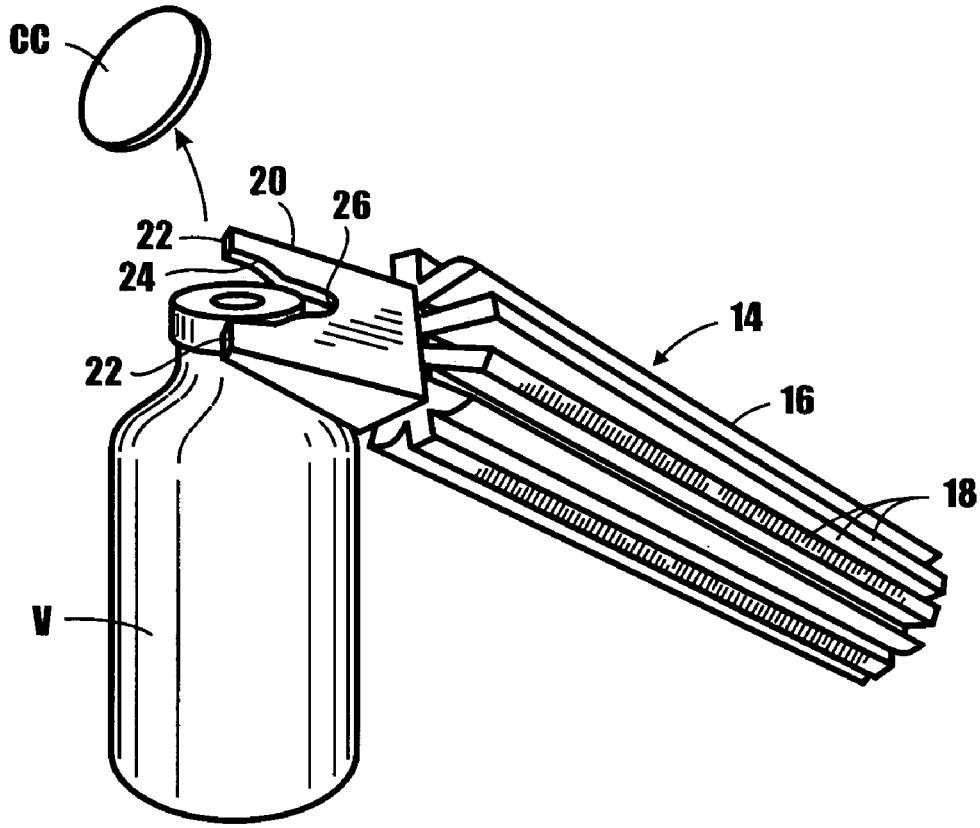
FIG. 6 is a generally perspective view illustrating the use of the tool in removing the protective cap on a conventional medicament vial.

Turning to FIG. 6, the detachment tool of the invention is shown being used to pry the closure cover CC, that is the detachable part, from the top, that is the fixed part, of a medicament container or vial V. When the detachment tool is so used, the hand and finger grip portion 16 is gripped by the fingers of the user and at least one of the pry elements 22 is inserted beneath the edge of the closure cover CC. With the pry element in this position, a pivotally downward force exerted on the pry tool will cause the closure cover to pop off in the manner shown in FIG. 6. As the user grips the hand and finger grip portion 16 the ribs 18 will yieldably deform permitting the user to comfortably and securely grip the tool.

Figure 7:
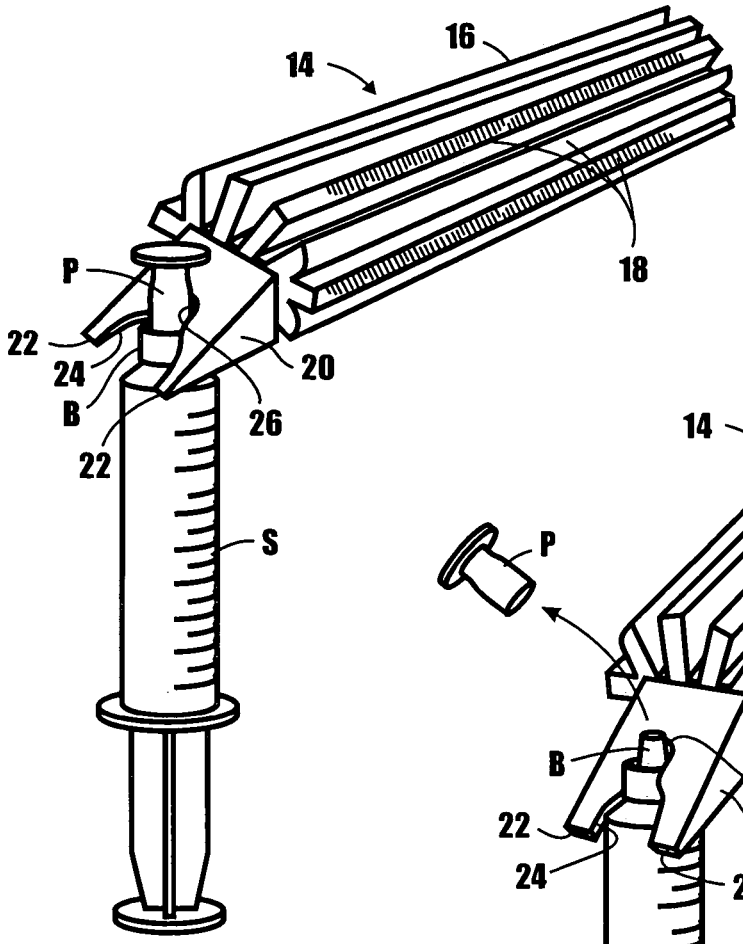
FIG. 7 is a generally perspective view illustrating the tool of the invention positioned for the removal of the closure member closing the outlet of a conventional syringes
Figure 8:
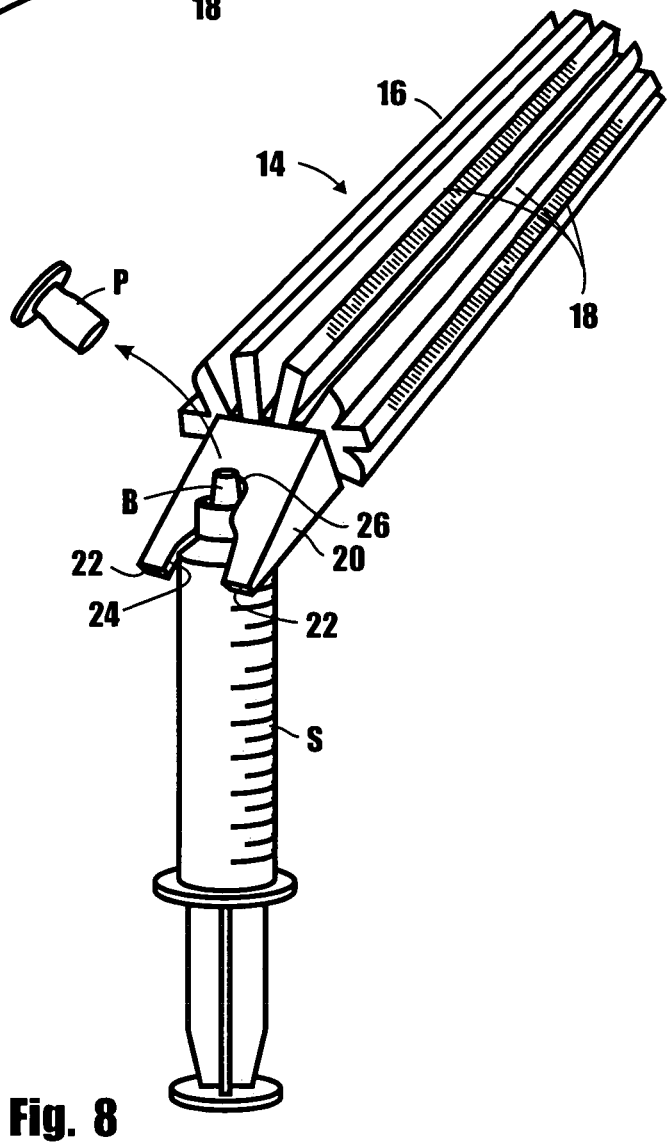
FIG. 8 is a generally perspective view, similar to FIG. 7, but showing the actual removal of the sealing member or stopper from the outlet port of the syringe.

Turning to FIGS. 7 and 8, the detachment tool of the invention is shown being used to remove the stopper plug P, that is the removable part, from the barrel B, that is the fixed part, of a conventional hypodermic syringe S. As illustrated in the drawings, this is accomplished by moving the smaller of the U-shaped openings 26 into gripping engagement with the plug P in the manner shown in FIG. 7. With the tool in this position, an upward pivotal movement of the tool will cause the plug P to be ejected from the syringe barrel in the manner shown in FIG. 8. Once again, due to the unique constriction of the finger and hand grip 16, the user can comfortably and securely grip the tool even though suffering from limited manual dexterity, arthritic pain or the like.

Figure 9:
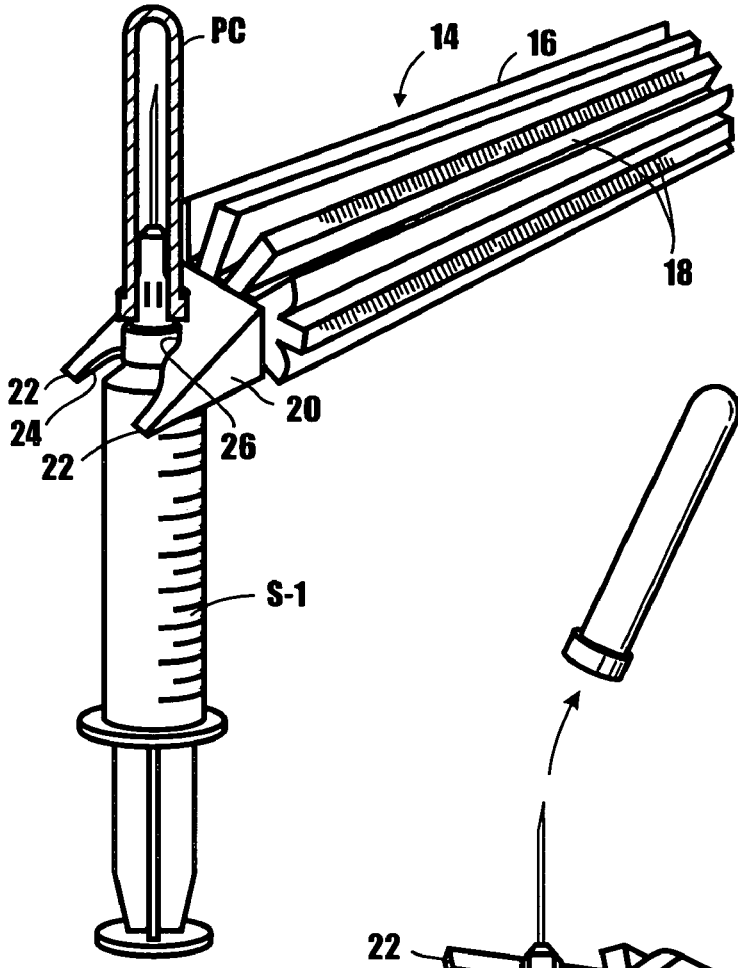
FIG. 9 is a generally perspective view showing the tool being positioned for removal of the protective cover covering the injection needle of a conventional syringe.
Figure 10:
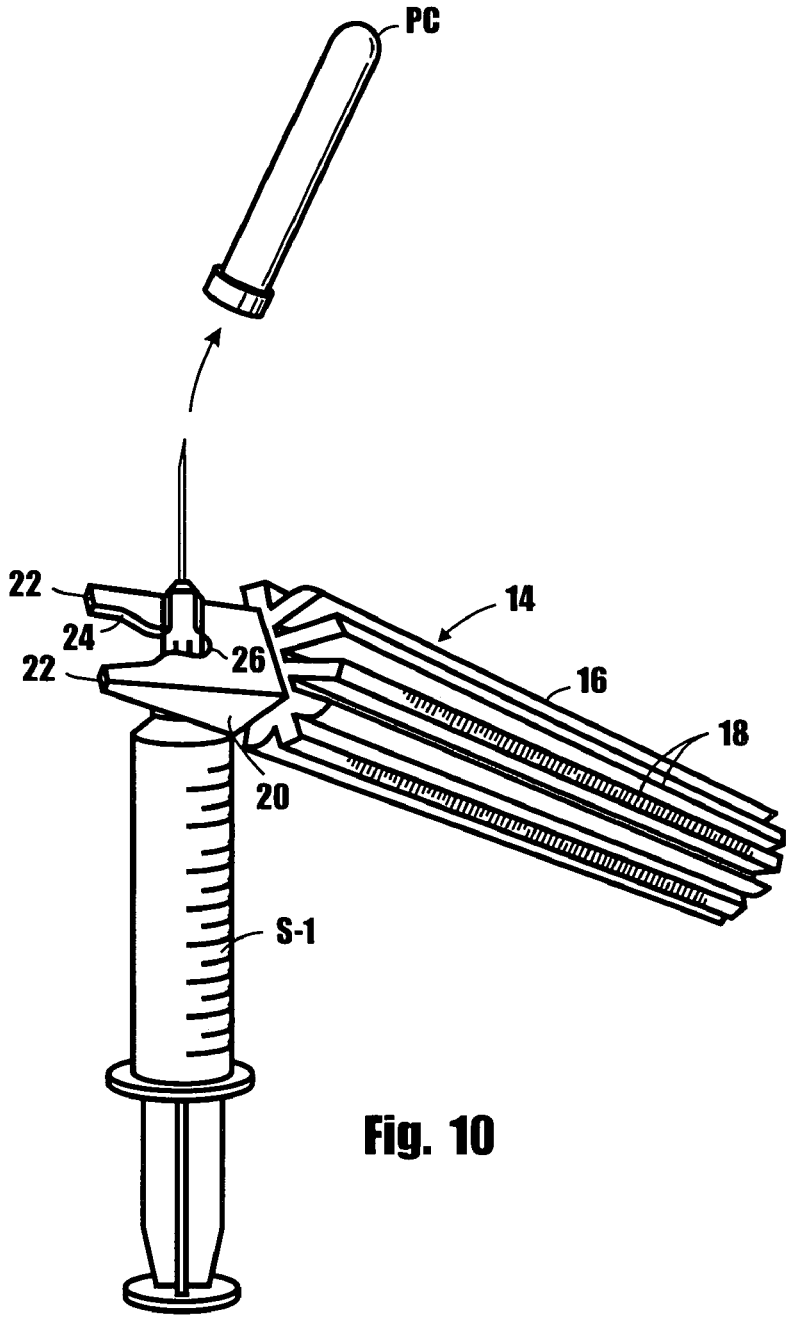
FIG. 10 is a generally perspective view showing the tool having removed the protective needle covering.

Referring lastly to FIGS. 9 and 10, the detachment tool of the invention is shown being used to remove the hypodermic needle protective cover PC from the hypodermic syringe S-1. In this instance the protective cover PC is the removable apart, while the syringe S-1 comprises the fixed part. This cover removal step is accomplished by moving the smaller of the U-shaped openings 26 into the position shown in FIG. 9 wherein the body portion 20 be of the wedge shaped body is positioned beneath the edge of the needle cover PC in the manner shown in FIG. 9. With the tool in this position, a downward pivotal movement of the tool in the manner shown in FIG. 10 will cause the cover PC to be ejected from the syringe barrel in the manner shown in FIG. 10. As before, due to the unique constriction of the finger and hand grip 16, the user can comfortably and securely grip the tool even though suffering from limited manual dexterity, arthritic pain or the like. It is to be understood that the foregoing discussion is only exemplary and it is to be appreciated that the detachment tool of the invention can be used to detach a wide variety of detachable parts from fixed parts of numerous types of articles. In this regard, when the removable part of the article is of a larger diameter than the diameter of opening 26, the larger opening 24 can be used to engage the removable portion of the article and urge its separation from the fixed part of the article.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A detachment tool for use in detaching a detachable part from a two-part article having a fixed part and a detachable part, said detachment tool comprising:

(a) an elongated hand and finger grip portion having a plurality of circumferentially spaced rib portions; and (b) a generally wedge-shaped extension portion extending from said grip portion, said extension portion having an end portion connected to said grip portion and a body portion terminating in a pry element, said body portion having a first generally U-shaped opening of a first size and an adjacent, second generally U-shaped opening of a second smaller size.

2. The tool as defined in claim 1 in which said grip portion is constructed from a yieldably deformable material.

* * * * *